US011224892B2

(12) United States Patent
Kerger et al.

(10) Patent No.: US 11,224,892 B2
(45) Date of Patent: Jan. 18, 2022

(54) DEVICE FOR LACQUER TRANSFER

(71) Applicant: Airbus Operations GmbH, Hamburg (DE)

(72) Inventors: Sebastian Kerger, Hamburg (DE); Alexander Gillessen, Stade (DE); Pierre Zahlen, Stade (DE)

(73) Assignee: AIRBUS OPERATIONS GmbH, Hamburg (DE)

( * ) Notice: Subject to any disclaimer, the term of this patent is extended or adjusted under 35 U.S.C. 154(b) by 0 days.

(21) Appl. No.: 16/868,878

(22) Filed: May 7, 2020

(65) Prior Publication Data

US 2020/0353498 A1 Nov. 12, 2020

(51) Int. Cl.

| | |
|---|---|
| ***B05C 1/08*** | (2006.01) |
| ***B05C 9/14*** | (2006.01) |
| ***B05C 1/02*** | (2006.01) |

(52) U.S. Cl.

CPC ..... *B05C 1/0834* (2013.01); *B05C 1/0808* (2013.01); *B05C 1/0873* (2013.01); *B05C 9/14* (2013.01); *B05C 1/027* (2013.01); *B05C 1/0813* (2013.01)

(58) Field of Classification Search

CPC ..... B05C 1/0834; B05C 1/0873; B05C 1/027; B05C 9/14; B05C 1/0813; B05C 1/0808; B29C 65/526

USPC ..... 118/304

See application file for complete search history.

(56) References Cited

U.S. PATENT DOCUMENTS 9,168,557 B2 * 10/2015 Saeki ..... B05C 1/0886
9,278,370 B2 * 3/2016 MacCormack ..... B05C 1/0817
2004/0168629 A1 * 9/2004 Miskech ..... B05C 1/027 118/109
2017/0341101 A1 11/2017 Mueller
2018/0281297 A1 10/2018 Pringle, IV et al.

FOREIGN PATENT DOCUMENTS

| | | |
|---|---|---|
| CN | 102463293 | 5/2012 |
| EP | 3 248 692 | 11/2017 |
| WO | 2015/155128 | 10/2015 |

OTHER PUBLICATIONS

German Search Report for German Application No. 10 2019 111 951.0 dated Feb. 18, 2020, 6 pages.

* cited by examiner

*Primary Examiner* — Laura Edwards
(74) *Attorney, Agent, or Firm* — Nixon & Vanderhye P.C.

(57) ABSTRACT

A device for a lacquer transfer is disclosed having a transfer roller, the transfer roller includes a cylindrical support body, a first ring element, a second ring element, and a tire, wherein the tire comprises a middle section forming a circumferential outer contact surface with several depressions. The transfer roller is configured to roll with the outer contact surface on a work surface of a workpiece for transferring lacquer from the outer contact surface and from the depressions to the work surface of the workpiece. The tire includes two annular end sections, which are attached to the support body resulting in two axially separated and circumferentially extending connections. The tire, the connections, and the outer shell of the support body are fluid-tight and arranged such that a fluid-tight main cavity is formed between the tire and the support body. The first and second ring elements are arranged in the main cavity and seated on the support body at a predefined distance in an axial direction (A) of the transfer roller from one another.

17 Claims, 3 Drawing Sheets

DEVICE FOR LACQUER TRANSFER

CROSS REFERENCE TO RELATED APPLICATION

This application claims priority to and incorporates by reference German Application Number DE 10 2019 111 951.0, filed May 8, 2019.

BACKGROUND

The present disclosure relates to a device for a lacquer transfer.

A device for a lacquer transfer is known from the publication WO 2015/155 128 A1. This publication discloses a device which is configured for transferring lacquer to a work surface. The device comprises a frame, a transfer roller with a circumferential outer contact surface with several depressions and a drive unit. The transfer roller is mounted rotatably about an axis of rotation at the frame. The drive unit is configured to drive rotation of the transfer roller about the axis of rotation. The device can be connected to a robot arm and moved via the robot arm in parallel to the work surface, such that the transfer roller rolls with its outer contact surface on the work surface for transferring lacquer from the outer contact surface, and in particular from the depressions, to the work surface. Before the outer contact surface or lacquer on the outer contact surface comes into contact with the work surface, the lacquer has to be dispensed onto the outer contact surface and into the depressions, such that the lacquer can be transferred subsequently to the work surface while the transfer roller rolls on the work surface.

When the transfer roller rolls with its outer contact surface on the work surface, the outer contact surface of the transfer roller is in contact with the work surface for transferring the lacquer from the outer contact surface, especially from the depressions, to the work surface. It is desirable that the transfer of the lacquer to the work surface results in a uniform lacquer layer on the work surface.

SUMMARY

The present disclosure provides a device which is configured for transferring lacquer via a transfer roller to a work surface of a work piece, such that a uniform lacquer layer is formed on the work surface.

The device is configured for a lacquer transfer. The device comprises a frame, a drive unit, a nozzle with a dispensing end for dispensing lacquer, and a transfer roller. The transfer roller is rotatably mounted on the frame, such that the transfer roller is rotatable relative to the frame about an axis of rotation, wherein the drive unit is configured to drive rotation of the transfer roller about the axis of rotation. The transfer roller comprises a cylindrical support body, a first ring element, a second ring element, and a tire. The first ring element, the second ring element, and the tire may each be elastically deformable. The tire comprises a middle section forming a circumferential outer contact surface with several depressions. The nozzle and the transfer roller are arranged such that lacquer is dispensable from the dispensing end onto the outer contact surface and into the depressions. The transfer roller is configured to roll with the outer contact surface on a work surface of a workpiece for transferring the lacquer from the outer contact surface and from the depressions to the work surface of the workpiece. The tire comprises two annular end sections. The annular end sections are arranged on opposite sides of the middle section. Further, the annular end sections are attached to a cylindrical outer shell of the support body resulting in two axially separated and circumferentially extending connections. The tire, the connections, and the outer shell of the support body are fluid-tight and arranged such that a fluid-tight main cavity is formed between the tire and the support body. The first and second ring elements are arranged in the main cavity and seated on the support body at a predefined distance in an axial direction of the transfer roller from one another such that the middle section of the tire between the first and second ring elements is prestrained in the axial direction. The first ring element comprises a first fluid-tight wall defining a circumferentially extending first ring cavity. The first ring cavity is filled with a first fluid. The second ring element comprises a second fluid-tight wall defining a circumferentially extending second ring cavity. The second ring cavity is filled with a second fluid. The device comprises a control unit or a controller adapted to control a first pressure in the first ring cavity and a second pressure in the second ring cavity.

The device comprises the frame. The frame may be configured to be releasably connected to a handling device, such as a robot. When the handling device is a robot, the frame may be releasably connected to a robot arm of the robot. The device may be moved translatorically in parallel to the work surface, preferably by the robot arm or another handling device, while the transfer roller rotates about the axis of rotation, such that the transfer roller rolls on the work surface for transferring lacquer onto the work surface.

The device comprises the drive unit. The drive unit may be directly or indirectly connected to the frame. The drive unit may be releasably connected to the frame. A releasable connection between the drive unit and the frame facilitates the exchange of the drive unit. The device may comprise connecting means for connecting the drive unit to the frame. The drive unit is configured to drive rotation of the transfer roller about the axis of rotation. The drive unit can drive rotation of the transfer roller about the axis of rotation when the device is in use such that the transfer roller rotates relative to the frame about the axis of rotation and rolls with the outer contact surface on the work surface.

The device comprises the nozzle with the dispensing end for dispensing lacquer. The nozzle may be directly or indirectly connected to the frame. The nozzle may be releasably connected to the frame. A releasable connection between the nozzle and the frame facilitates the exchange of the nozzle. The device may comprise connecting means for connecting the nozzle to the frame. The nozzle may be disconnected form the frame, in particular for maintenance purposes. The nozzle may be automatically disconnected from the frame. Further, the nozzle may be automatically connected and/or reconnected to the frame. The nozzle may be connected to the frame, such that the nozzle can be releasably locked in a working position. If this lock is released, the nozzle may be pivoted from the working position in a non-working position via a hinge, which may hold the nozzle at the frame. The nozzle may be serviced in the non-working position. The nozzle may be automatically pivoted from the working position to the non-working position as well as from the non-working position to the working position via the hinge.

The device comprises the transfer roller. The transfer roller is rotatably mounted on the frame. The rotatable mounting on the frame of the transfer roller allows the transfer roller to rotate relative to the frame about the axis of rotation. The drive unit is configured to drive rotation of the transfer roller such that, when the transfer roller is driven, the transfer roller rotates about the axis of rotation.

The transfer roller comprises the cylindrical support body. The support body may be rotatably mounted on an axis such that the transfer roller can rotate relative to the frame about the axis of rotation. The support body may be mounted on the axis via a bearing to enable rotation of the support body about the axis of rotation. To allow the rotation of the support body about the axis of rotation, the axis may be mounted on the frame. The axis may be releasably connected to the frame. The axis may be releasably connected to the frame via at least one quick release. The axis may be automatically disconnected from the frame and/or connected and/or reconnected to the frame. The support body may be formed of a material, which is stiff compared to the material of the first ring element, the material of the second ring element, and the material of the tire. If a part of the device or a material is considered stiff in the context of the present invention, the part or material comprises a comparatively high resistance against elastic deformation. To provide a stiff support body, the support body may be formed of a metal, especially aluminum. For example, the Young's modulus of the support body is at least 60 GPa. Further, the axis may be formed of a material, which is stiff compared to the material of the first ring element, the material of the second ring element, and the material of the tire. The axis maybe formed of a metal.

The transfer roller comprises the first ring element and the second ring element. The first ring element may extend annularly around the support body. Similarly, the second ring element may extend annularly around the support body. The first ring element and the second ring element may both have the form of a torus. The first ring element and the second ring element may both be a respective inner tube. The first ring element and the second ring element may both be elastically deformable. The elastic deformability of the first ring element and the second ring element ensures that the first ring element and the second ring element can both be brought from an undeformed state to an elastically deformed state, when a force acts on the first ring element and on the second ring element, respectively, and that the first ring element and the second ring element can both be brought from the elastically deformed state back to the undeformed state when the force does not act on the first ring element and on the second ring element anymore. The first and second ring elements may each be formed of a material, which has a lower stiffness than the stiffness of the support body. If a part of the device or a material is considered to have a low stiffness in the context of the present invention, the part or material comprises a comparatively low resistance against elastic deformation. To provide a first ring element and a second ring element with each having a low stiffness, the first ring element and the second ring element may each be formed of an elastomer, especially of a synthetic rubber. For example, the Young's modulus of the first ring element is at most 10 GPa. Similarly, the Young's modulus of the second ring element is at most 10 GPa. The first and second ring elements may deform when the transfer roller rolls with the outer contract surface on the work surface such that the first and second ring elements adapt their shape in a respective contact patch section of the first and second ring elements to the shape of the work surface.

The transfer roller comprises the tire. The tire may extend annularly around the support body. The tire may be ring-shaped and provides an uninterrupted circumferential wall around the support body. The wall may the outer contact surface of the middle section, wherein the outer contact surface may face in a radial direction of the transfer roller. The tire may be elastically deformable. The elastic deformability of the tire ensures that the tire can be brought from an undeformed state to an elastically deformed state, when a force acts on the tire, and that the tire can be brought from the elastically deformed state back to the undeformed state when the force does not act on the tire anymore. The tire may be formed of a material, which has a lower stiffness than the stiffness of the support body. To provide the tire with a low stiffness, the tire may be formed of an elastomer, especially of silicone. For example, the Young's modulus of the tire is at most 10 GPa. The tire may deform when the transfer roller rolls with the outer contract surface on the work surface such that the outer contact surface adapts its shape in a contact patch section of the tire to the shape of the work surface.

The first ring element, the second ring element, and the tire may each form a different component. In this case, the first ring element, the second ring element, and the tire can be attached to each other to form a section of the transfer roller. Alternatively, the first ring element, the second ring element, and the tire may integrally form a unitary component. The unitary component may be formed by the first ring element, the second ring element, and the tire as one piece. The first ring element and the tire as well as the second ring element and the tire may merge into each other, respectively, to form the unitary component.

The tire comprises the middle section forming a circumferential outer contact surface with several depressions. The tire may be formed as one piece. The tire may be formed by the middle section and the end sections, wherein one of the end sections and the middle section as well as the other one of the end sections and the middle section may merge into each other, respectively. Each of the depressions can receive lacquer from the dispensing end of the nozzle and release lacquer to the work surface of the workpiece. The nozzle and the transfer roller are arranged such that lacquer is dispensable from the dispensing end into the depressions. When lacquer is dispensed from the dispensing end into the depressions, the lacquer can later be released from the depressions and to the work surface of the workpiece. The depressions may be evenly distributed about the outer contact surface. The depressions can be formed by recesses arranged at the outer contact surface. The depressions can have a predefined size and/or structure. A mean structure size of the depressions can be in the range of 0.1 micrometer to 1000 micrometer. Each of the depressions can be open towards a surrounding of the transfer roller in the radial direction and closed towards an interior space of the transfer roller.

The nozzle and the transfer roller are arranged such that lacquer is dispensable from the dispensing end onto the outer contact surface and into the depressions. In particular, a lacquer film is dispensable from the dispensing end onto the outer contact surface and into the depressions. Preferably, the lacquer of the lacquer film fills the depressions and the lacquer film extends in the axial direction and partly in the circumferential direction of the transfer roller. The lacquer film may be integrally formed of several sections, of which one section may be a depression section, which fills the depressions, and a remaining section, which is also referred to as bulk or bulk part. The transfer roller may be configured to roll with the outer contact surface of the transfer roller on the work surface of the work piece for transferring lacquer from the outer contact surface and from the depressions to the work surface of the work piece, such that the lacquer film is transferred to the work surface. The transfer of the lacquer film to the work surface may comprise a transfer of the lacquer from the depressions to the work surface as well as a transfer of the bulk part to the work surface. If the transfer of the lacquer from the depressions to the work surface is described with regard to the present invention, the transfer of the lacquer from the depressions to the work surface may comprise the possible transfer of the bulk part to the work surface and/or the possible transfer of the lacquer from the depressions on top of the bulk part on the work surface.

The transfer roller is configured to roll with the outer contact surface on the work surface of the workpiece. This configuration of the transfer roller allows the transfer of the lacquer from the outer contract surface and from the depressions to the work surface of the workpiece. When lacquer is received by the depressions of the outer contact surface and the transfer roller rolls with the outer contact surface on the work surface of the workpiece the lacquer can be transferred from the depressions to the work surface.

The tire comprises two annular end sections, which are arranged on opposite sides of the middle section. Each of the end sections may be connected to a respective side of two annular sides of the middle section to form the tire. Each of the annular end sections is attached to the cylindrical outer shell of the support body. The outer shell of the support body may be formed by a circumferential wall of the support body. The outer shell may face in the radial direction of the transfer roller. The attachment of each of the annular end sections to the cylindrical outer shell results in two axially separated and circumferentially extending connections. Each of the annular end sections of the tire may be releasably attached to the cylindrical outer shell. The releasable attachment of the tire to the cylindrical outer shell facilitates the exchange and maintenance of the tire. The annular end sections of the tire may be automatically disconnected from the outer shell and/or connected and/or reconnected to the outer shell.

The tire, the connections, and the outer shell of the support body are fluid-tight and arranged such that a fluid-tight main cavity is formed between the tire and the support body. The fluid-tight main cavity may be filled with a gas with positive pressure. The positive pressure may prestrain the middle section of the tire in the radial direction of the transfer roller such that the outer contact surface of the middle section can be pressed against the work surface with an evenly distributed rolling force.

The first and second ring elements are arranged in the main cavity. The arrangement of the first and second ring elements in the main cavity allows the first and second ring elements to support the tire in the radial direction. The first and second ring elements are seated on the support body, preferably such that the support body can support the first and second ring elements in the radial direction. The first and second ring elements are seated on the support body at a predefined distance in the axial direction of the transfer roller from one another. The predefined distance ensures that the distance between the first and second ring elements is sufficiently high such that the circumferential outer contract surface is wide enough in the axial direction for dispensing sufficiently wide lacquer layers on the work surface. The predefined distance in the axial direction is constant along the entire circumference of the support body such that an evenly wide lacquer layer can be dispensed on the work surface.

The first and second ring elements are seated on the support body at a predefined distance in the axial direction of the transfer roller from one another such that the middle section of the tire between the first and second ring elements is prestrained in the axial direction. The middle section of the tire may be elastically deformed such that the middle section of the tire is prestrained in the axial direction. The attachment of the two annular end sections of the tire to the outer shell of the support body and a deformation of the tire due to the arrangement of the first and second ring elements may result in the middle section being prestrained in the axial direction. The prestrainment of the middle section in the axial direction may lead to a cylindrical shape of the middle section, which leads to a more uniform lacquer layer on the work surface.

The first ring element comprises a first fluid-tight wall defining a circumferentially extending first ring cavity. Further, the second ring element comprises a second fluid-tight wall defining a circumferentially extending second ring cavity. The first fluid-tight wall and the second fluid-tight wall allow that a fluid can be enclosed in the first ring cavity and in the second ring cavity, respectively. The first ring cavity is filled with a first fluid and the second ring cavity is filled with a second fluid. The first fluid and the second fluid may each be a gas or a liquid. The gas and the liquid provide two alternatives for different resistances against deformation of the first and second ring elements.

The device comprises a control unit adapted to control a first pressure in the first ring cavity and a second pressure in the second ring cavity. A first pressure sensor may be arranged inside the first ring cavity and be adapted to measure the first pressure. Similarly, a second pressure sensor may be arranged inside the second ring cavity and be adapted to measure the second pressure. The first pressure sensor and the second pressure sensor may each be connected to the control unit and adapted to transmit a pressure signal representing the first pressure and the second pressure, respectively. The control unit may be connected to a fluid conveyor means, which is attachable to a resealable first opening in the first ring element and a resealable second opening in the second ring element, such that the first fluid is transferrable into and out of the first ring cavity and the second fluid is transferrable into and out of the second ring cavity. The control unit may be adapted to transmit a control signal based on the pressure signals to the fluid conveyor means, such that the fluid conveyor means transfers the first fluid into and out of the first ring cavity and the second fluid into and out of the second ring cavity based on the control signal such that the first pressure approaches a first target pressure and the second pressure approaches a second target pressure. The first pressure in the first ring cavity and the second pressure in the second ring cavity may be controlled, such that the fluid in each ring cavity has a predefined pressure, i.e. the first target pressure and the second target pressure, respectively. Each fluid-tight wall may be elastically deformable in the radial direction. The elastic deformation of each fluid-tight wall may be allowed by the first ring element and the second ring element, respectively, since each fluid-tight wall may be deformed against the pressure of each respective fluid.

Each of the first and second ring elements may be elastically deformable and seated on the support body. The first and second ring elements may extend beyond the support body in the radial direction. The extension of the first and second ring elements beyond the support body in the radial direction may prevent a direct contact between the support body and the work surface or an indirect contact between the support body and the work surface via the tire. When the support body is formed of a material, which is stiff compared to the work surface, a direct contact between the support body and the work surface may cause mechanical damage of the work surface. Further, if the tire has a lower stiffness than the stiffness of the support body, an indirect contact between the support body and the work surface via the tire can also cause mechanical damage of the work surface. The first and second ring element can each serve as a bumper of the transfer roller, wherein each bumper prevents a direct collision between the support body and the work surface or an indirect collision between the support body and the work surface via the tire. When the first pressure in the first ring cavity and the second pressure in the second ring cavity are controlled, the first pressure can be maintained close to the first target pressure and the second pressure can be maintained close to the second target pressure, wherein the first target pressure and the second target pressure can be chosen to be optimal for avoiding a direct contact between the support body and the work surface and an indirect contact between the support body and the work surface via the tire.

When the transfer roller rolls with the outer contract surface on the work surface of the workpiece for transferring the lacquer from the depressions to the work surface of the workpiece, the first and second ring elements may be deformed in the radial direction due to a contact force between the outer contact surface and the work surface. The deformation of the first and second ring elements is preferably elastic such that a distance between the axis of rotation and the work surface can be determined from a measured value from a force measurement of the contact force. In case the deformation of the first and second ring elements is linear-elastic in the radial direction, the distance between the axis of rotation and the work surface can be determined from the measured value of the force measurement of the contact force in an easy manner. Furthermore, the distance between the axis of rotation and the work surface can be controlled by measuring the contact force, which may lead to a high uniformity of the lacquer layer. The resistance against deformation of the first ring element depends on the first pressure and the resistance against deformation of the second ring element depends on the second pressure. When the first pressure in the first ring cavity and the second pressure in the second ring cavity are controlled such that the first pressure is maintained close to the first target pressure and the second pressure is maintained close to the second target pressure, a deduction from a measured value from a force measurement of the contact force to the actual deformation of the first and second ring elements, respectively, is much more precise. Thereby, the distance between the axis of rotation and the work surface can be determined more precisely from a measured value from a force measurement of the contact force when the first pressure in the first ring cavity and the second pressure in the second ring cavity are controlled.

In case the device comprises a hardening unit, the hardening unit may be directly or indirectly connected to the frame. Further, the hardening unit may be arranged at a given distance from the axis of rotation and at a given position relative to the axis of rotation. Therefore, if the distance between the axis of rotation and the work surface is known and the position of the hardening unit relative to the axis of rotation, the distance between the hardening unit and the work surface can be determined. Furthermore, the distance between the hardening unit and the work surface can be controlled by measuring the contact force, which may improve the uniformity of the curing of the lacquer layer. In addition, the distance between the hardening unit and the work surface can be determined more precisely from a measured value from a force measurement of the contact force when the first pressure in the first ring cavity and the second pressure in the second ring cavity are controlled, since the resistance against deformation of the first ring element depends on the first pressure and the resistance against deformation of the second ring element depends on the second pressure.

The first ring element and the second ring element may each comprise a circumferential outer contact surface, wherein the outer contact surface of the first ring element may be in contact with a first inner contact surface of the tire and the outer contact surface of the second ring element may be in contact with a second inner contact surface of the tire such that the middle section of the tire is prestrained in the axial direction. As discussed before, the first pressure in the first ring cavity and the second pressure in the second ring cavity are controllable, such that the first pressure is maintained close to the first target pressure and the second pressure is maintained close to the second target pressure. The first target pressure and the second target pressure can be chosen such that the first and second fluid-tight walls may not be deformed against the first and second pressures, respectively, due to the prestrainment of the middle section. The outer contact surfaces of the first and second ring elements provide contact surfaces with which the tire may be in contact with. The outer contact surfaces of the first and second ring elements and the prestrainment of the middle section of the tire provide shape compliance of the tire such that the uniformity of the lacquer layer on the work surface can be increased. By controlling the first and second pressures, the shape compliance of the tire may be further increased such that the uniformity of the lacquer layer on the work surface can be even further increased. Further, the outer contact surfaces of the first and second ring elements may each provide a circumferential edge, over which the tire can be pulled during assembly.

In addition, if the first and second ring elements extend beyond the support body in the radial direction, the outer contact surfaces of the first and second ring elements may be further away from the axis of rotation than a section of the support body, which is arranged furthest from the axis of rotation. Therefore, if the first inner contact surface of the tire is in contact with the outer contact surface of the first ring element and the second inner contact surface of the tire is in contact with the outer contact surface of the second ring element, less to no wrinkles are formed in the tire when the two annular end sections are attached to the outer shell of the support body and the first and second ring elements are arranged in the main cavity compared to the situation where the transfer roller does not comprise the first and second ring elements.

Further, when the first and second pressures are controlled such that the first pressure is maintained close to the first target pressure and the second pressure is maintained close to the second target pressure, the first target pressure and the second target pressure can be chosen such that the first and second fluid-tight walls may not be deformed against the first and second pressures, respectively, due to the prestrainment of the middle section. Thereby a relatively high prestrainment of the middle section may be achieved, which further reduces the number of wrinkles in the tire. The reduction of the number and size of wrinkles in the tire or even the prevention of any wrinkles in the tire increases the uniformity of the lacquer layer on the work surface. Since the middle section forms the outer contact surface with several depressions, a reduction in or an avoidance of wrinkles in the middle section is desirable.

In summary, the device is configured for transferring lacquer via a transfer roller to a work surface of a work piece, such that a uniform lacquer layer is formed on the work surface.

According to an exemplary embodiment of the device, the control unit is adapted to control a main pressure in the main cavity. A main pressure sensor may be arranged inside the main cavity and be adapted to measure the main pressure. The main pressure sensor may be connected to the control unit and adapted to transmit a pressure signal representing the main pressure. The fluid conveyor means may comprise a main opening or may be attachable to a resealable main opening in the support body, such that the gas, with which the main cavity may be filled, is transferrable into and out of the main cavity. The control unit may be adapted to transmit a control signal based on the pressure signal received from the main pressure sensor to the fluid conveyor means, such that the fluid conveyor means transfers the gas into and out of the main cavity based on the control signal such that the main pressure approaches a main target pressure. The main pressure in the main cavity may be controlled, such that the gas in the main cavity has a predefined pressure, i.e. the main target pressure. The tire, especially the middle section of the tire, may be elastically deformable in the radial direction. The elastic deformation of the tire, especially of the middle section of the tire, may be allowed by the transfer roller, since the tire, especially the middle section of the tire, may be deformed against the pressure of the gas inside the main cavity.

According to an exemplary embodiment of the device, the device comprises a fluid conveyor means, which is attached to a resealable first opening in the first ring element and a resealable second opening in the second ring element, such that the first fluid is transferrable into and out of the first ring cavity and the second fluid is transferrable into and out of the second ring cavity. The fluid conveyor means may comprise a tank device with a reservoir, which is filled with fluid and configured to receive fluid from the first and second ring cavities and to provide fluid to the first and second ring cavities via the resealable first opening in the first ring element and the resealable second opening in the second ring element. The fluid conveyor means may be connected to the control unit. The fluid conveyor means may be adapted to receive a control signal from the control unit. Based on the control signal, the fluid conveyor means can transfer the first fluid into and out of the first ring cavity and the second fluid into and out of the second ring cavity, such that the first pressure approaches the first target pressure and the second pressure approaches the second target pressure.

According to an exemplary embodiment of the device, the main cavity is filled with a gas with a predefined pressure such that the middle section is prestrained in a radial direction of the transfer roller. The prestrainment of the middle section in the radial direction of the transfer roller can improve the uniformity of the distribution of the rolling force with which the outer contact surface of the middle section can be pressed against the work surface.

According to an exemplary embodiment of the device, the thickness of the middle section of the tire between the outer contact surface of the tire and a confinement surface of the tire facing the main cavity is at most 1 cm. Particularly, the thickness of the middle section, especially in the radial direction, is at most 1 cm. A thickness of the middle section of at most 1 cm is especially preferred if the device comprises a hardening unit, which is arranged within the interior space formed by the transfer roller and such that light, especially UV-light, transmitted by the hardening unit through the tire and towards the work surface on which the transfer roller rolls with the outer contact surface. The thickness of the middle section may be at most 1 cm, which provides a tolerable transmittance of the middle section for the UV-light transmitted by the hardening unit such that the lacquer can be hardened to achieve a uniform lacquer layer on the work surface. The thickness of the middle section can be at most 0.5 cm or at most 0.1 cm. A reduction in the thickness of the middle section increases the transmittance of the middle section such that the curing of the lacquer layer on the work surface is accelerated at the same power level of the UV-light transmitted by the hardening unit.

According to an exemplary embodiment of the device the tire is formed of at least two layers. The formation of the tire of at least two layers allows the layers to be formed differently such that, for example, different materials or geometries can be chosen for each layer. If the tire is formed of at least two layers, the mechanical properties of the tire can be tailored for rolling with the outer contract surface on the work surface of the workpiece for transferring the lacquer from the depressions to the work surface of the workpiece. The at least two layers can be formed of the same material or of different materials. Further, the at least two layers can have the same geometry or different geometries. The tire may also be formed of one layer. When the tire is formed of one layer, the tire can be manufactured in a particularly simple manner According to an exemplary embodiment of the device, the number of layers is at most five. When the number of layers is at most five, the amount of charge carriers carrying an electric charge on the transfer roller can be kept at a tolerable level. The number of layers can be at most four or at most three or at most two. A reduction in the number of layers can further reduce the amount of charge carriers carrying an electric charge on the transfer roller.

According to an exemplary embodiment of the device, the tire comprises a first layer of the at least two layers and a second layer of the at least two layers, wherein the first layer is arranged on a side of the tire facing the main cavity, wherein the second layer forms the outer contact surface of the tire. The first layer may be chosen to be fluid-tight such that the tire is fluid-tight. The second layer may be chosen to be elastically deformable only to such an extent that the depressions remain undeformed when the transfer roller rolls with the outer contract surface on the work surface of the workpiece.

According to an exemplary embodiment of the device, each end section extends transversely to an extension of the middle section. Due to the extension of the end sections transversely to the extension of the middle section, the end sections can transfer forces in the radial direction of the transfer roller when the middle section is prestrained in the radial direction.

According to an exemplary embodiment of the device, the tire comprises silicone. It has been found that if the tire comprises silicone, the outer contact surface of the middle section can be pressed against the work surface with a uniformly distributed rolling force. The uniformity of the distribution of the rolling force can be increased if the tire, or at least the middle section of the tire, is completely formed of silicone.

According to an exemplary embodiment of the device, the transfer roller comprises a first clamping element and a second clamping element, wherein the first clamping element is in contact with the first annular end section of the two annular end sections such that the first annular end section is pressed on the outer shell of the support body to form a first connection of the two connections, wherein the second clamping element is in contact with the second annular end section of the two annular end sections such that the second annular end section is pressed on the outer shell of the support body to form a second connection of the two connections. Each of the first clamping element and the second clamping element enable that the first connection and the second connection are each a releasable connection. Each of the first clamping element and the second clamping element can be a hose clamp.

According to an exemplary embodiment of the device, the support body comprises a transparent cylinder and two rims, wherein the rims are mounted to the cylinder at two opposing ends of the cylinder such that the cylinder and the two rims are arranged coaxial to each other. The support body can be formed in several pieces. The transparency of the cylinder allows light, especially UV-light, to be transmitted through the cylinder. Therefore, the cylinder may be configured to transmit UV-light-waves. The transmission of light through the cylinder is especially beneficial if the device comprises a hardening unit as described above. The outer shell of the support body may be formed by the two rims. The first ring element may be seated on a first rim of the two rims and the second ring element may be seated on a second rim of the two rims. The rims are mounted to the cylinder at two opposing ends of the cylinder such that the cylinder and the two rims are arranged coaxial to each. Due to this arrangement, the rotation of the first rim and the second rim about the axis of rotation may be synchronized.

According to an exemplary embodiment of the device, the cylinder is made of glass. When the cylinder is made of glass, the cylinder has a tolerable stiffness for connecting the first rim and the second rim with each other. Further, if the cylinder is made of glass, sufficient transmittance of the cylinder is provided for the transmission of light, especially UV-light, through the cylinder.

According to an exemplary embodiment of the device, the cylinder forms a confinement surface facing the main cavity. In case the cylinder forms a confinement surface facing the main cavity, the confinement surface may be fluid-tight and arranged such that the confinement surface confines the main cavity.

According to an exemplary embodiment of the device, the support body comprises a first support element extending in the radial direction such that the first ring element is secured against movement in the axial direction by the first support element, wherein the support body comprises a second support element extending in the radial direction such that the second ring element is secured against movement in the axial direction by the second support element. When the first and second ring elements are arranged in the main cavity and seated on the support body at a predefined distance in the axial direction of the transfer roller from one another such that the middle section of the tire between the first and second ring elements is prestrained in the axial direction, a force may act between the tire and each of the first and second ring elements is such a way that the force acts on each of the first and second ring elements in the axial direction and towards an axial center of the main cavity, respectively. The first support element and the second support element can secure the first ring element and the second ring element, respectively, especially when the transfer roller rolls with the outer contract surface on the work surface of the workpiece for transferring the lacquer from the depressions to the work surface of the workpiece. The first support element and the second support element can each be formed as a rim. The first support element and the second support element can hold the first and second ring elements, respectively, during the rolling of the transfer roller on the work surface in position. Further, if the device comprises a hardening unit, the first and second support elements can protect the first and second ring elements, respectively, from the light, especially from UV-light, transmitted by the hardening unit. A protection of the first and second ring elements, respectively, from the light may increase the durability of the first and second ring elements. Due to the first and second support elements, the first and second ring elements may each deform in the axial direction and each away from the axial center of the main cavity, when the transfer roller rolls with the outer contact surface on the work surface. The deformation in the axial direction and away from the axial center of the main cavity may reduce of even prevent the formation of the wrinkles in the middle section of the tire.

BRIEF DESCRIPTION OF THE DRAWINGS

Further features, advantages and application possibilities of the present invention may be derived from the following description of exemplary embodiments and/or the figures. Thereby, all described and/or visually depicted features for themselves and/or in any combination may form an advantageous subject matter and/or features of the present invention independent of their combination in the individual claims or their dependencies. Furthermore, in the figures, same reference signs may indicate same or similar objects.

In the accompanying drawings, like reference characters refer to the same or similar parts throughout the different views. The drawings are not necessarily to scale, emphasis instead being placed upon illustrating particular principles, discussed below.

DETAILED DESCRIPTION OF SOME EMBODIMENTS

Some embodiments will now be described with reference to the Figures.

Figure 1:
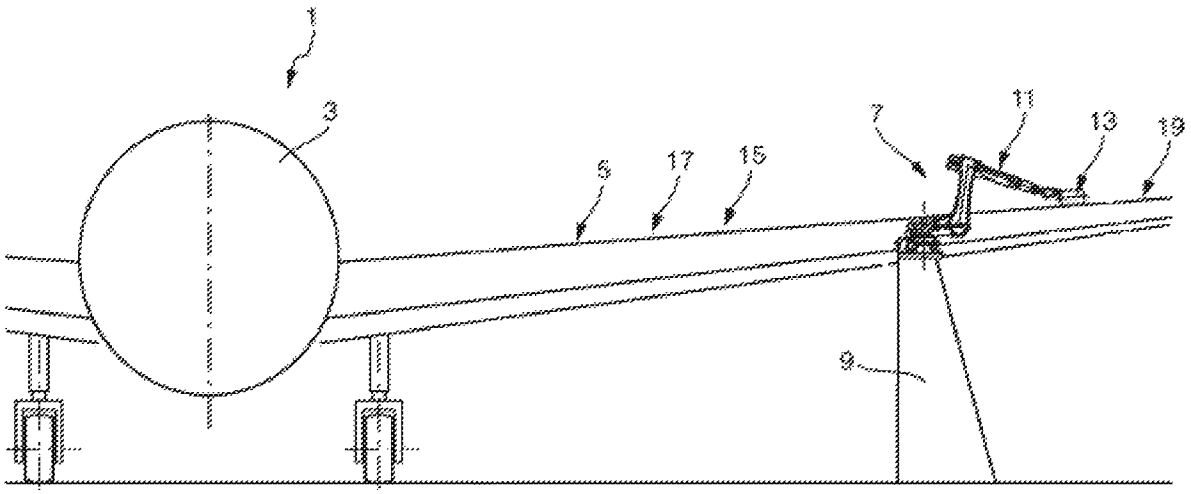
FIG. 1 schematically illustrates a part of an aircraft with a wing and a device arranged according to an embodiment for transferring lacquer onto an upper wing surface of the wing.

FIG. 1 schematically illustrates a part of an aircraft 1, which comprises a fuselage 3 and a wing 5. A robot 7 is seated on a rack 9. The robot 7 comprises a movable robot arm 11. A device 13 according to an embodiment of the present invention is mounted at an end of the robot arm 11, such that the device 13 can be moved by the robot 7. The device 13 is configured for transferring lacquer onto a work surface 15 of a workpiece 17. According to the example shown in FIG. 1, the workpiece 17 can be formed by the wing 5 of the aircraft 1 and an upper wing surface 19 of the wing 5 can form the work surface 15.

Figure 2:
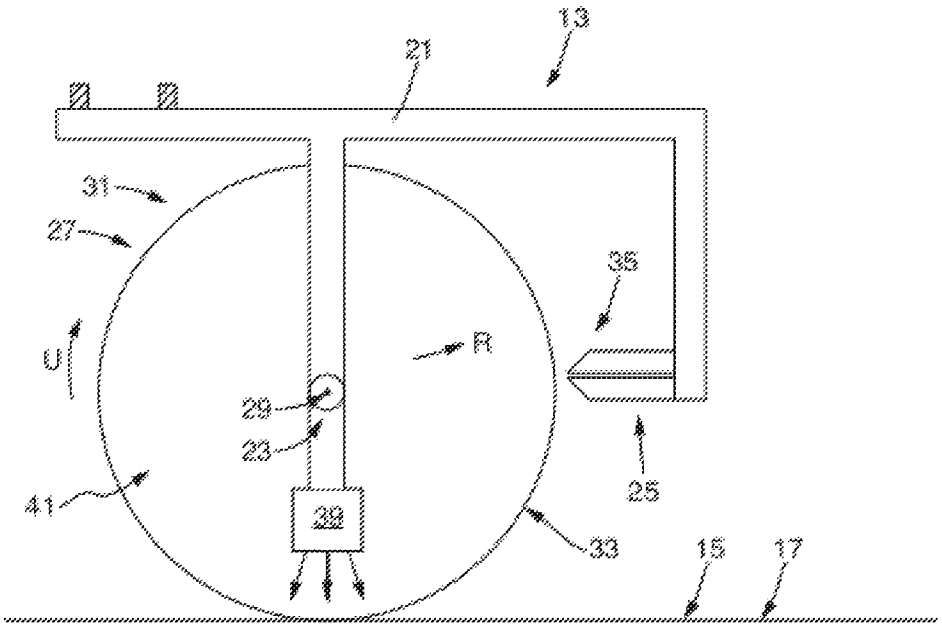
FIG. 2 schematically illustrates the embodiment of the device in FIG. 1 in a cross-sectional view.

FIG. 2 schematically illustrates the embodiment of the device 13 in FIG. 1 in a cross-sectional view. The device 13 comprises a frame 21, a drive unit 23, a nozzle 25, and a transfer roller 27. The device 13 can be attached via the frame 21 to the robot arm 11. However, instead of a robot 7 any other handling device may be used, which is configured to move the device 13 in space. The frame 21 may be adapted to be releasably connected to a handling device, such as the robot 7.

The transfer roller 27 is mounted rotatably, in particular by means of at least one bearing, about an axis of rotation 29 on the frame 21 such that the transfer roller 27 is rotatable about the axis of rotation 29 relative to the frame 21. The transfer roller 27 comprises a tire 31, which may be elastically deformable. The tire 31 comprises a circumferential outer contact surface 33 with several depressions. The nozzle 25 comprises a dispensing end 35 for dispensing lacquer onto the outer contact surface 33 and into the depressions. The nozzle 25 and the transfer roller 27 are arranged such that lacquer is dispensable from the dispensing end 35 onto the outer contact surface 33 and into the depressions.

The drive unit 23 is configured to drive rotation of the transfer roller 27 about the axis of rotation 29, such that the tire 31 continuously rotates around the axis of rotation 29. When lacquer is dispensed from the dispensing end 35 of the nozzle 25 onto the outer contact surface 33 and into the depressions, the lacquer rotates around the axis of rotation 29 in a rotation direction U. When the lacquer reaches the work surface 15 of the workpiece 17, the lacquer is transferred from the depressions and from the outer contact surface 33 to the work surface 15. Therefore, the transfer roller 27 is configured to roll with the outer contact surface 33 on the work surface 15 of the workpiece 17 for transferring the lacquer from the outer contact surface 33 and from the depressions to the work surface 15 of the workpiece 17.

The device 13 comprises a hardening unit 39. The hardening unit 39 is configured for hardening the lacquer, preferably contactless. The hardening unit 39 can be formed by a UV-light unit. The hardening unit 39 is directly or indirectly connected to the frame 21. Moreover, the hardening unit 39 can be arranged within an interior space 41 formed by the transfer roller 27. For instance, if the hardening unit 39 is formed by a UV-light unit, the tire 31 of the transfer roller 27 may be configured to transmit UV-light-waves. Thus, the tire 31 can be transparent for UV-light. The hardening unit 39 can be arranged, such that UV-light is emitted towards the work surface 15 on which the tire 31 of the transfer roller 27 can roll. The lacquer may by hardenable by UV-light. The device 13 may be configured to control the drive unit 23 and/or the hardening unit 39, such that lacquer transferred to the work surface 15 is immediately hardened via UV-light emitted by the hardening unit 39.

Figure 3:
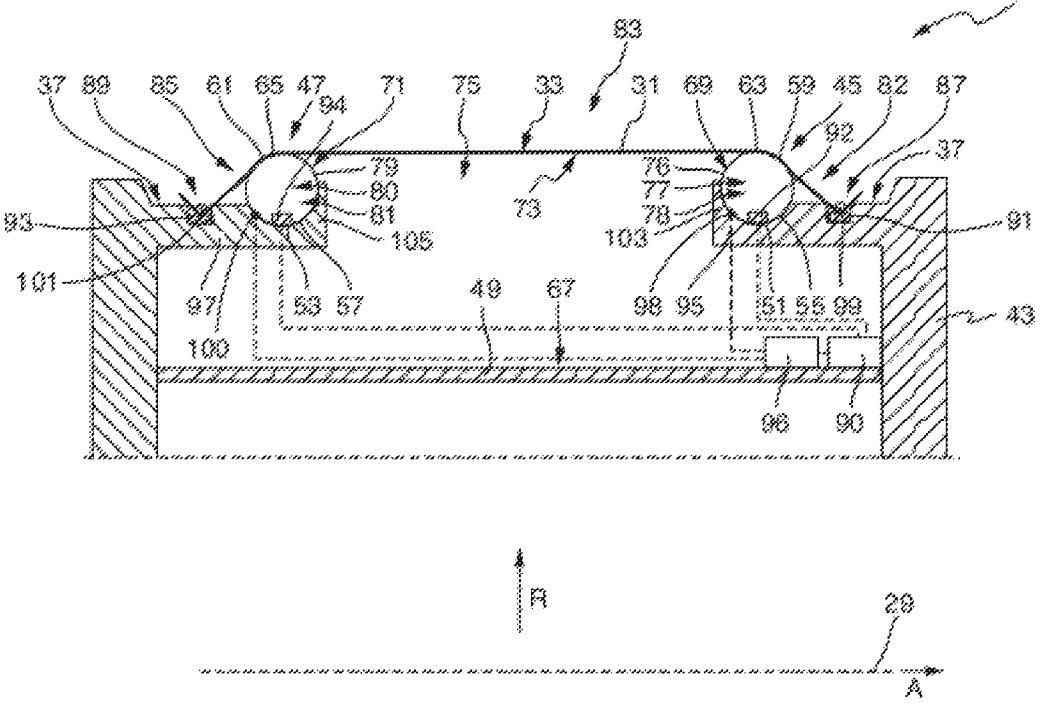
FIG. 3 schematically illustrates a section of an embodiment of a transfer roller of the device in FIG. 1 and FIG. 2 in a cross-sectional view.

FIG. 3 schematically illustrates a section of an embodiment of the transfer roller 27 of the device 13 in FIG. 1 and FIG. 2 in a cross-sectional view. The transfer roller 27 comprises the tire 31, a cylindrical support body 43, a first ring element 45, and a second ring element 47. The tire 31 comprises a middle section 83, which forms the circumferential outer contact surface 33, and two annular end sections 82, 85. The two annular end sections 82, 85 are arranged on opposite sides of the middle section 83. The first ring element 45 comprises a first fluid-tight wall 76 defining a circumferentially extending first ring cavity 77, which is filled with a first fluid 78 such that a first pressure is in the first ring cavity 77. The second ring element 47 comprises a second fluid-tight wall 79 defining a circumferentially extending second ring cavity 80, which is filled with a second fluid 81 such that a second pressure is in the second ring cavity 80. The first and second ring elements 45, 47 may be elastically deformable against the first and second pressures, respectively.

Further, the support body 43 comprises a transparent cylinder 49, which is made of glass, and two rims 95, 97. The rims 95, 97 are mounted to the cylinder 49 at two opposing ends of the cylinder 49 such that the cylinder 49 and the two rims 95, 97 are arranged coaxial to each other, especially with the axis of rotation 29 as their common axis. The support body 43 comprises a circumferential first outer contact surface 51 and a circumferential second outer contact surface 53. The first ring element 45 and the second ring element 47 each comprises a circumferential inner contact surface 55, 57. The first outer contact surface 51 of the support body 43 is in contact with the inner contact surface 55 of the first ring element 45. The second outer contact surface 53 of the support body 43 is in contact with the inner contact surface 57 of the second ring element 47, such that the support body 43 supports the first and second ring elements 45, 47 in a radial direction R of the transfer roller 27.

The first ring element 45 and the second ring element 47 each comprise a circumferential outer contact surface 59, 61. The tire 31 comprises a circumferential first inner contact surface 63 and a circumferential second inner contact surface 65. The outer contact surface 59 of the first ring element 45 is in contact with the first inner contact surface 63 of the tire 31. The outer contact surface 61 of the second ring element 47 is in contact with the second inner contact surface 65 of the tire 31, such that the first and second ring elements 45, 47 support the tire 31 in the radial direction R.

The two annular end sections 82, 85 are attached to a cylindrical outer shell 37 of the support body 43 resulting in two axially separated and circumferentially extending connections 87, 89. The tire 31, the connections 87, 89, and the outer shell 37 of the support body 43 are fluid-tight and arranged such that a fluid-tight main cavity 75 is formed between the tire 31 and the support body 43. The first and second ring elements 45, 47 are arranged in the main cavity 75 and seated on the support body 43 at a predefined distance in an axial direction A of the transfer roller 27 from one another such that the middle section 83 of the tire 31 between the first and second ring elements 45, 47 is prestrained in the axial direction A. The main cavity 75 is filled with a gas with a predefined pressure such that the middle section 83 is prestrained in the radial direction R of the transfer roller 27.

The device 13 comprises a control unit 90. The control unit 90 is adapted to control the first pressure in the first ring cavity 77 and the second pressure in the second ring cavity 80. A first pressure sensor 92 is arranged inside the first ring cavity 77 and is adapted to measure the first pressure. In addition, a second pressure sensor 94 is arranged inside the second ring cavity 80 and is adapted to measure the second pressure. The first pressure sensor 92 and the second pressure sensor 94 are each connected to the control unit 90 and adapted to transmit a pressure signal representing the first pressure and the second pressure, respectively, to the control unit 90. The control unit 90 is connected to a fluid conveyor means 96. The fluid conveyor means 96 is attached to a resealable first opening 98 in the first ring element 45 and a resealable second opening 100 in the second ring element 47, such that the first fluid 78 is transferrable into and out of the first ring cavity 77 and the second fluid 81 is transferrable into and out of the second ring cavity 80. The control unit 90 may be adapted to transmit a control signal based on the pressure signals to the fluid conveyor means 96, such that the fluid conveyor means 96 transfers the first fluid 78 into and out of the first ring cavity 77 and the second fluid 81 into and out of the second ring cavity 80 based on the control signal such that the first pressure approaches a first target pressure and the second pressure approaches a second target pressure. Each fluid-tight wall 76, 79 may be elastically deformable in the radial direction R. The elastic deformation of each fluid-tight wall 76, 79 may be allowed by the first ring element 45 and the second ring element 47, respectively, since each fluid-tight wall 76, 79 may be deformed against the pressure of each respective fluid 78, 81.

The control unit 90 in FIG. 3 may be adapted to control a main pressure in the main cavity 75. A main pressure sensor, which is not shown in FIG. 3, may be arranged inside the main cavity 75 and be adapted to measure the main pressure. The main pressure sensor may be connected to the control unit 90 and adapted to transmit a pressure signal representing the main pressure to the control unit 90. The fluid conveyor means 96 may comprise a main opening or may be attachable to a resealable main opening in the support body 43, such that the gas, with which the main cavity 75 is filled, is transferrable into and out of the main cavity 75. The control unit 90 may be adapted to transmit a control signal based on the pressure signal received from the main pressure sensor to the fluid conveyor means 96, such that the fluid conveyor means 96 transfers the gas into and out of the main cavity 75 based on the control signal such that the main pressure approaches a main target pressure. The main pressure in the main cavity 75 may be controlled, such that the gas in the main cavity 75 has a predefined pressure, i.e. the main target pressure. The tire 31, especially the middle section 83 of the tire 31, may be elastically deformable in the radial direction R. The elastic deformation of the tire 31, especially of the middle section 83 of the tire 31, may be allowed by the transfer roller 27, since the tire 31, especially the middle section 83 of the tire 31, may be deformed against the pressure of the gas inside the main cavity 75.

The transfer roller 27 comprises a first clamping element 99 and a second clamping element 101. The first clamping element 99 is in contact with the first annular end section 82 of the two annular end sections 82, 85 such that the first annular end section 82 is pressed on the outer shell 37 of the support body 43 to form the first connection 87 of the two connections 87, 89. The second clamping element 101 is in contact with the second annular end section 85 of the two annular end sections 82, 85 such that the second annular end section 85 is pressed on the outer shell 37 of the support body 43 to form the second connection 89 of the two connections 87, 89. The first end section 82 of the two end sections 82, 85 extends transversely to an extension of the middle section 83. The second end section 85 of the two end section 82, 85 extends transversely to the extension of the middle section 83. The tire 31 comprises an elastic material, especially silicone.

The outer shell 37 of the support body 43 comprises a circumferential first mounting surface and a circumferential second mounting surface. The first annular end section 82 is pressed on the first mounting surface of the outer shell 37 of the support body 43 and the second annular end section 85 is pressed on the second mounting surface of the outer shell 37 of the support body 43. The first mounting surface of the support body 43 is formed by a first seal 91 of the support body 43. The second mounting surface of the support body 43 is formed by a second seal 93 of the support body 43.

The support body 43 comprises a circumferential confinement surface 67, which is formed by the cylinder 49 and faces the main cavity 75. The first ring element 45 comprises a circumferential confinement surface 69, the second ring element 47 comprises a circumferential confinement surface 71, and the tire 31 comprises a circumferential confinement surface 73. The confinement surfaces 67, 69, 71, 73 confine a central section of the main cavity 75.

The thickness of the middle section 83 of the tire 31 between the outer contact surface 33 of the tire 31 and the confinement surface 73 of the tire 31 facing the main cavity 75 is at most 1 cm. The tire 31 is formed of at least two layers and the number of layers is at most five. The tire 31 comprises a first layer of the at least two layers and a second layer of the at least two layers, wherein the first layer is arranged on a side of the tire 31 facing the main cavity 75, wherein the second layer forms the outer contact surface 33 of the tire 31. The tire 31 comprises a first layer of the layers and a second layer of the layers. The first inner contact surface 63, the second inner contact surface 65, and the confinement surface 73 of the tire 31 are each formed by the first layer. The outer contact surface 33 of the tire 31 is formed by the second layer. Even though the tire 31 is formed of at least two layers, the tire 31 can be formed of a single layer.

The support body 43 comprises a first support element 103 extending in the radial direction R such that the first ring element 45 is secured against movement in the axial direction A by the first support element 103. The support body 43 comprises a second support element 105 extending in the radial direction R such that the second ring element 47 is secured against movement in the axial direction A by the second support element 105.

It is additionally pointed out that "comprising" does not rule out other elements, and "a" or "an" does not rule out a multiplicity. It is also pointed out that features that have been described with reference to one of the above exemplary embodiments may also be disclosed as in combination with other features of other exemplary embodiments described above. Reference signs in the claims are not to be regarded as restrictive.

While at least one exemplary embodiment is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A device for a lacquer transfer, comprising:

a frame, a drive unit, a nozzle with a dispensing end for dispensing lacquer, and a transfer roller, wherein the transfer roller is rotatably mounted on the frame, such that the transfer roller is rotatable relative to the frame about an axis of rotation, wherein the drive unit is configured to drive rotation of the transfer roller about the axis of rotation, wherein the transfer roller comprises:

a cylindrical support body, a first ring element, a second ring element, and a tire, wherein the tire comprises a middle section forming a circumferential outer contact surface with several depressions, wherein the nozzle and the transfer roller are arranged such that lacquer is dispensable from the dispensing end onto the outer contact surface and into the depressions, wherein the transfer roller is configured to roll with the outer contact surface on a work surface of a workpiece for transferring the lacquer from the outer contact surface and from the depressions to the work surface of the workpiece, wherein the tire comprises two annular end sections, which are arranged on opposite sides of the middle section and are attached to a cylindrical outer shell of the support body resulting in two axially separated and circumferentially extending connections, wherein the tire, the connections, and the outer shell of the support body are fluid-tight and arranged such that a fluid-tight main cavity is formed between the tire and the support body, wherein the first and second ring elements are arranged in the main cavity and seated on the support body at a predefined distance in an axial direction (A) of the transfer roller from one another such that the middle section of the tire between the first and second ring elements is prestrained in the axial direction (A), wherein the first ring element comprises a first fluid-tight wall defining a circumferentially extending first ring cavity, which is filled with a first fluid, wherein the second ring element comprises a second fluid-tight wall defining a circumferentially extending second ring cavity (80), which is filled with a second fluid, and wherein the device comprises a control unit adapted to control a first pressure in the first ring cavity and a second pressure in the second ring cavity.

2. The device according to claim 1, wherein the control unit is adapted to control a main pressure in the main cavity.

3. The device according to claim 1, wherein the device comprises a fluid conveyor means, which is attached to a resealable first opening in the first ring element and a resealable second opening in the second ring element, such that the first fluid is transferrable into and out of the first ring cavity and the second fluid is transferrable into and out of the second ring cavity.

4. The device according to claim 1, wherein the main cavity is filled with a gas with a predefined pressure such that the middle section is prestrained in a radial direction (R) of the transfer roller.

5. The device according to claim 1, wherein a thickness of the middle section of the tire between the outer contact surface of the tire and a confinement surface of the tire facing the main cavity is at most 1 cm.

6. The device according to claim 1, wherein the tire is formed of at least two layers.

7. The device according to claim 6, wherein the number of layers is at most five.

8. The device according to claim 6, wherein the tire comprises a first layer of the at least two layers and a second layer of the at least two layers, wherein the first layer is arranged on a side of the tire facing the main cavity, wherein the second layer forms the outer contact surface of the tire.

9. The device according to claim 1, wherein each end section extends transversely to an extension of the middle section.

10. The device according to claim 1, wherein the tire comprises silicone.

11. The device according to claim 1, wherein the transfer roller comprises a first clamping element and a second clamping element, wherein the first clamping element is in contact with a first annular end section of the two annular end sections such that the first annular end section is pressed on the outer shell of the support body to form a first connection of the two connections, wherein the second clamping element is in contact with a second annular end section of the two annular end sections such that the second annular end section is pressed on the outer shell of the support body to form a second connection of the two connections.

12. The device according to claim 1, wherein the support body comprises a transparent cylinder and two rims, wherein the rims are mounted to the cylinder at two opposing ends of the cylinder such that the cylinder and the two rims are arranged coaxial to each other.

13. The device according to claim 12, wherein the cylinder is made of glass.

14. The device according to claim 12, wherein the cylinder forms a confinement surface facing the main cavity.

15. The device according to claim 1, wherein the support body comprises a first support element extending in the radial direction (R) such that the first ring element is secured against movement in the axial direction (A) by the first support element, wherein the support body comprises a second support element extending in the radial direction (R) such that the second ring element is secured against movement in the axial direction by the second support element.

16. A device for a lacquer transfer, comprising:

a frame, a drive unit, a nozzle with a dispensing end for dispensing lacquer, and a transfer roller, wherein the transfer roller is rotatably mounted on the frame, such that the transfer roller is rotatable relative to the frame about an axis of rotation, wherein the drive unit is configured to drive rotation of the transfer roller about the axis of rotation, wherein the transfer roller comprises:

a cylindrical support body, a first ring element, a second ring element, and a tire, wherein the tire comprises a middle section forming a circumferential outer contact surface with several depressions, wherein the nozzle and the transfer roller are arranged such that lacquer is dispensable from the dispensing end onto the outer contact surface and into the depressions, wherein the transfer roller is configured to roll with the outer contact surface on a work surface of a workpiece for transferring the lacquer from the outer contact surface and from the depressions to the work surface of the workpiece, wherein the tire comprises two annular end sections, which are arranged on opposite sides of the middle section and are attached to a cylindrical outer shell of the support body resulting in two axially separated and circumferentially extending connections, wherein the tire, the connections, and the outer shell of the support body are fluid-tight and arranged such that a fluid-tight main cavity is formed between the tire and the support body, wherein the first and second ring elements are arranged in the main cavity and seated on the support body at a predefined distance in an axial direction (A) of the transfer roller from one another such that the middle section of the tire between the first and second ring elements is prestrained in the axial direction (A), wherein the first ring element comprises a first fluid-tight wall defining a circumferentially extending first ring cavity, which is filled with a first fluid, wherein the second ring element comprises a second fluid-tight wall defining a circumferentially extending second ring cavity (80), which is filled with a second fluid, and wherein the device comprises a controller configured to control a first pressure in the first ring cavity and a second pressure in the second ring cavity.

17. The device according to claim 16, wherein the controller is configured to control a main pressure in the main cavity.

* * * * *